United States Patent [19]

Carreno

[11] Patent Number: 4,631,538

[45] Date of Patent: Dec. 23, 1986

[54] SINGLE FREQUENCY MULTITRANSMITTER TELEMETRY SYSTEM

[75] Inventor: Victor A. Carreno, Newport News, Va.

[73] Assignee: The United States of America as represented by the Administrator of the National Aeronautics and Space Administration, Washington, D.C.

[21] Appl. No.: 470,113

[22] Filed: Feb. 28, 1983

[51] Int. Cl.[4] ..... G08C 19/16

[52] U.S. Cl. ..... 340/870.18; 340/825.5; 371/63; 375/88

[58] Field of Search ..... 340/870.18, 870.26, 340/825.5, 825.73; 371/63, 57; 375/88, 91; 455/63, 206

[56] References Cited

U.S. PATENT DOCUMENTS

| | | | |
|---|---|---|---|
| 3,559,167 | 1/1971 | Carter | 371/63 |
| 3,793,636 | 2/1974 | Clark | 340/870.18 |
| 4,464,653 | 8/1984 | Winner | 340/870.18 |
| 4,464,756 | 8/1984 | Tromborg | 371/63 |

FOREIGN PATENT DOCUMENTS

| | | | |
|---|---|---|---|
| 0651479 | 3/1979 | U.S.S.R. | 371/57 |

*Primary Examiner*—John W. Caldwell, Sr.
*Assistant Examiner*—Michael F. Heim
*Attorney, Agent, or Firm*—William H. King; Howard J. Osborn; John R. Manning

[57] ABSTRACT

A telemetry system in which a plurality of transmitters are frequency shift keying modulated. A receiver including an overlapping detector retains the transmitted data when there is no overlap in data transmitted and discards the transmitted data when there is an overlap in data transmitted.

10 Claims, 7 Drawing Figures

SINGLE FREQUENCY MULTITRANSMITTER TELEMETRY SYSTEM

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates to a single frequency multitransmitter telemetry system in which the transmitted data is retained when only one transmitter is transmitting and is discarded when more than one transmitter is transmitting.

Research programs in general aviation require the instrumentation of aircraft for test flight purposes. Space, weight, and power consumption are critical factors to be considered in the design of the system and instrumentation of the aircraft. Installation rapidness is also a design consideration in order to make the system cost-effective; primarily because of manpower and aircraft leasing costs.

It is the primary object of this invention to provide a telemetry system that will improve the test flight data availability, accelerate the installation process, and reduce data cost.

Another object of this invention is to provide a simple single frequency telemetry system that will deliver a substantial amount of data at low cost.

Other objects and advantages of this invention will be apparent hereinafter in the specification and drawings.

SUMMARY OF THE INVENTION

The invention consists essentially of a plurality of sensor-transmitter units at different locations, with individual signal conditioning and logic, which send sampled data signals to a single receiver. The transmitters operate independently on the same frequency in a frequency shift keying (FSK) modulation system and are not synchronized to the receiver. The problem of reception of data from more than one transmitter simultaneously is solved by discarding the data—when there is an overlap of data from two or more transmitters, the data is discarded and when there is no overlap the data is retained. The invention utilizes a unique overlap detection technique to determine if data should be retained or discarded.

DETAILED DESCRIPTION OF THE INVENTION

Figure 1:
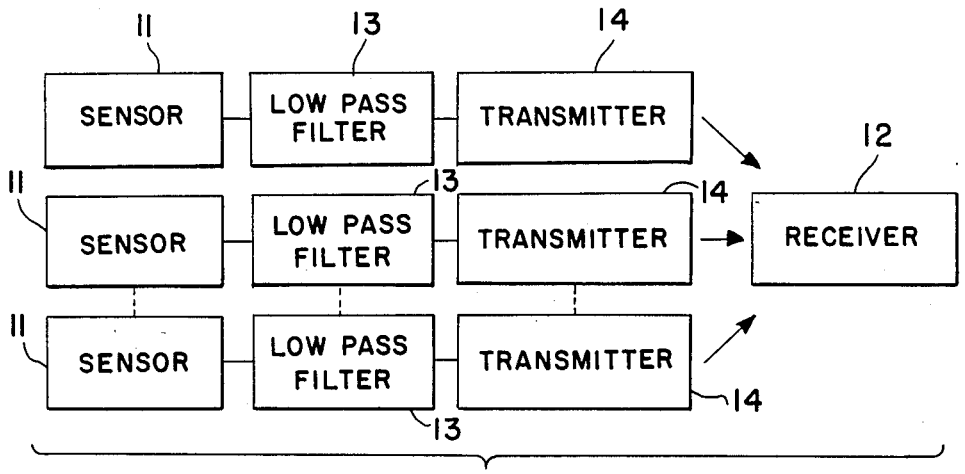
FIG. 1 is a block diagram of the invention.

Turning now to the embodiment of the invention selected for illustration in the drawings, the number 11 in FIG. 1 designates sensors that are at different locations on, for example, an aircraft for sensing data that is to be transmitted to a receiver 12. As shown, there can be any desired number of sensors 11. The analog output of each sensor 11 is applied through a low pass filter 13 to a transmitter 14.

Figure 2:
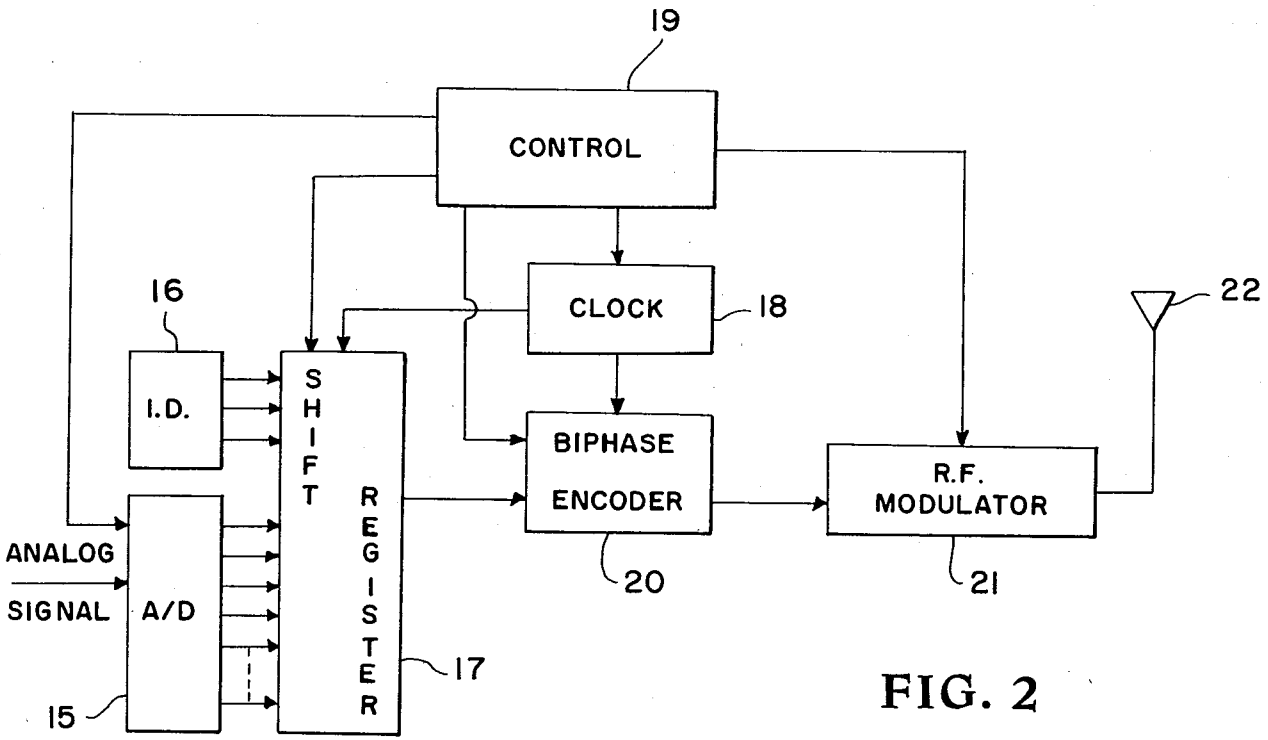
FIG. 2 is a block diagram of one of the transmitters shown in FIG. 1.

Each of the transmitters 14, as shown in FIG. 2, includes an analog-to-digital converter 15 which converts the analog signal from low pass filter 13 to a parallel digital output. This parallel output along with a parallel output from identification bits 16 are applied to a shift register 17. The identification bits 16 identifies the sensor 11 from which the data emanates. The pulses from a clock 18 and a control 19 are connected to shift register 17 to provide a serial output from shift register 17 to a Manchester biphase encoder 20. The output of encoder 20 is modulated by an RF modulator 21 and then transmitted by means of an antenna 22. Control 19, which is connected to analog-to-digital converter 15, shift register 17, clock 18 and modulator 21, enables and disables the logic and analog circuitry for the proper sequencing of the operation; minimizes the battery power consumption by deactivating the circuitry not used; and sets the sampling rate for the transmitter. The transmitter employs frequency shift keying (FSK) for the RF link. The output of encoder 20 is a serial binary signal which represents the analog signal applied to converter 15. During each time a binary "1" is applied from encoder 20 to modulator 21, a frequency $f_o$ is transmitted and during each time a binary "0" is applied to modulator 21, a frequency $f_o+\Delta f$ is transmitted. At the end of each word transmitted a signal from control 19 cuts off the output from modulator 21 so that neither the frequency $f_o$ nor the frequency $f_o+\Delta f$ is transmitted.

Figure 3:
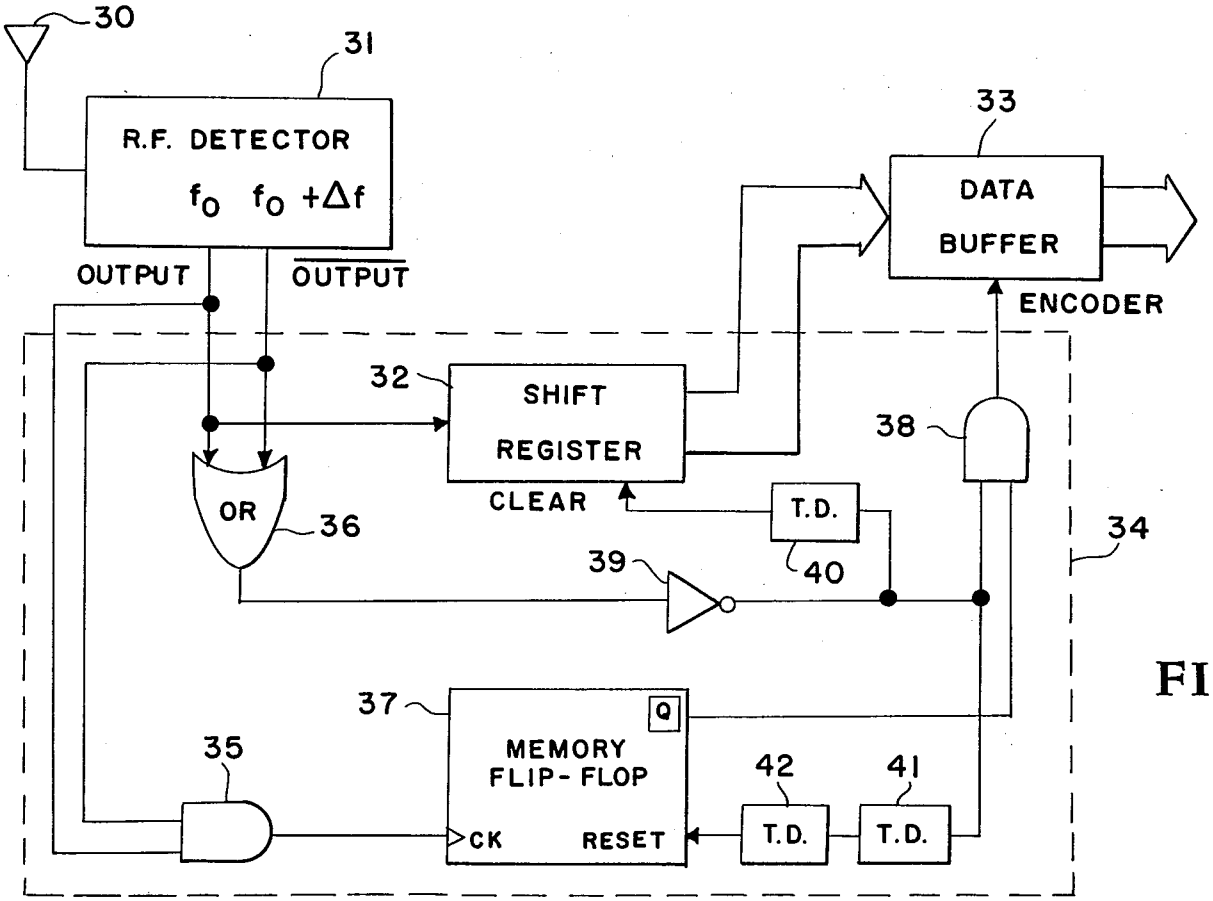
FIG. 3 is a block diagram of the receiver shown in FIG. 1.

As shown in FIG. 3, the receiver 12 includes an antenna 30 which receives the RF signals from the transmitters 12. The received signals are detected by an RF detector 31 to produce at its two output the $f_o$ frequency signals and the $f_o+\Delta f$ frequency signals. The $f_o$ frequency signals are applied to a shift register 32 which collects the transmitted words from the transmitters. Each collected word is passed through a data buffer 33 if there is no overlapping of transmissions from the transmitters or is not passed through data buffer 33 if there is overlapping of transmissions from two or more of the transmitters.

An overlapping detector 34 includes, in addition to shift register 32, an "and" gate 35 and an "or" gate 36, both of which are connected to the two outputs of detector 31. The output of gate 35 is applied to a memory flip flop 37 which has its Q output connected to an "and" gate 38. Whenever flip flop 37 is reset its Q output goes to a binary "1". Whenever both of the outputs of detector 31 are binary "1"s the output of gate 35 becomes a binary "1" which changes the state of flip flop 37. This change of state causes the Q output to go to a binary "0" and remain there until the flip flop is reset. The output of gate 36 is applied through an inverter 39 to gate 38, through a time delay 40 to the clear input of shift register 32 and through time delays 41 and 42 (total time delay greater than time delay of 40) to the reset input of memory flip flop 37. Whenever a binary "1" appears at the output of gate 38, data buffer 33 is enabled thereby allowing the word in shift register 32 to pass through. Whenever a binary "0" appears at the output of gate 38, data buffer 33 blocks the word in shift register 32 thereby allowing the word to be discarded when the shift register is cleared.

This invention operates on the multiplexing scheme of retaining data if only one transmitter is transmitting and discarding data if more than one transmitters are transmitting at the time the data is received. To carry out this scheme, it is assumed that if two or more transmitters are transmitting simultaneously at some time during the transmission of a word there will be binary "1"s at both outputs of detector 31.

Figure 4:
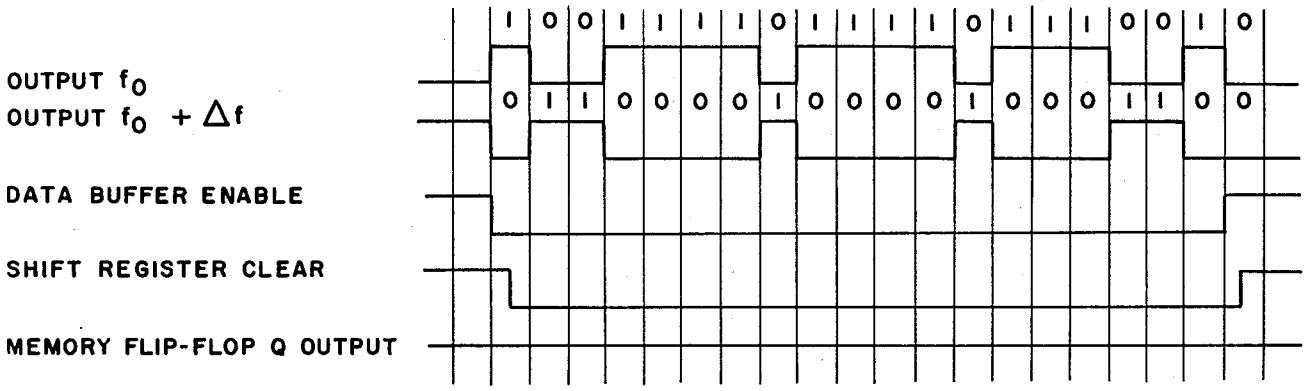
FIG. 4 is a timing diagram for the receiver in FIG. 3 when there is no overlapping data being transmitted: only one transmitter is transmitting.

Assuming first that only one transmitter 14 is transmitting. Then the information transmitted will appear at the $f_o$ output of detector 31. The diagram in FIG. 4 shows a typical word from the transmitting transmitter which flows into shift register 32. Note that with only one transmitter transmitting the output $f_o+\Delta f$ is the "not" function of the output $f_o$. That is, at no time during the transmission of the word is both outputs at a binary "1". Inasmuch as the Q output of memory flip flop 37 is a binary "1" at the beginning of a word it will remain a binary "1" throughout the transmission of the word in FIG. 4 since the output of gate 35 will not be a binary "1". Throughout the transmission of the word either output $f_o$ or output $f_o+\Delta f$ is at binary "1", making the output of inverter at binary "0" thereby not letting gate 38 enable data buffer 33 during the transmission of the word. At the end of the transmission of the word both output $f_o$ and output $f_o+\Delta f$ become a binary "0" thereby producing a binary "1" at the output of inverter 39. This binary "1" produces a binary "1" at the output of gate 38 enabling data buffer 33. The binary "1" at the output of inverter 39 is also delayed by a time delay 40 and then clears shift register 32. Hence, as can be seen, when only one transmitter is transmitting the word transmitted is stored in shift register 32 until the end of the word, then it is retained by passing through data buffer 33. A short time later shift register 32 is cleared making it ready to receive another transmitted word.

Figure 5:
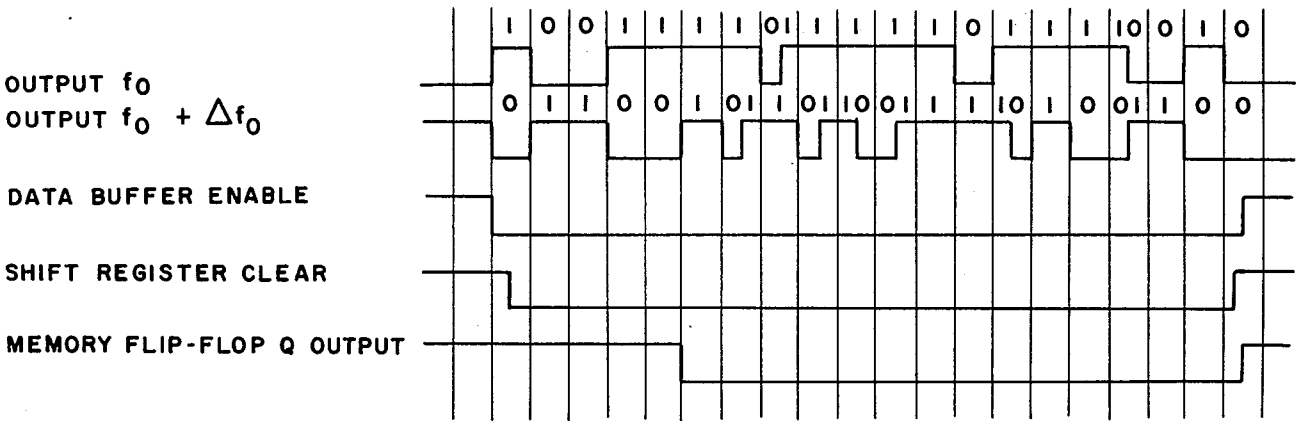
FIG. 5 is a timing diagram for the receiver in FIG. 3 when there is overlapping data being transmitted.

Assume now that more than one transmitter 14 is transmitting. The timing diagram in FIG. 5 is an example. Sometime during the transmission of a word, both of the outputs of detector 31 are a binary "1". This produces a binary "1" at the output of gate 35 thereby changing the state of flip flop 37: the Q output changes from a binary "1" to a binary "0". Thereafter at the end of the transmission of the word the binary "0"s at the outputs of detector 31 produce a binary "1" at the output of inverter 39 which will not enable data buffer 33 but clears shift register 32 and then resets memory flip flop 37. Hence, the word in shift register 32 is discarded and the receiver is ready for the reception of another word.

A computer simulation was developed to predict and analyze the overlap characteristics. It involved an algorithm in which two variables start from a value of zero and are incremented according to $X \leftarrow X+\Delta X$ where $\Delta X=1/f_s$ for a given transmitter, and $f_s$ is the sample rate. The incidences of overlap are detected and analyzed by comparing each value of one variable to each possible value that the second variable can assume. If the difference of the two values being compared is less than the sample length, an overlap occurs and an output is generated with the values of the variables at that instant. (Sample length is the time necessary to transmit the sample in a binary encoded format.) The computer simulation was made with two different rates of transmission; one fixed and the other adjustable. Slight variations in the adjustable transmission rate produce significant changes in the overlap occurrence. An illustration of the overlap occurence can be seen in the following examples of results for 40 μs sample length.

| Trans. Rate #1 (fixed) samples/second | Trans. Rate #2 samples/second | No. of Trans. | No. of Overlaps |
|---|---|---|---|
| 10.0 | 10.122474485 | 100,000 | 80 |
| 10.0 | 10.130380452 | 100,000 | 81 |
| 10.0 | 10.100000000 | 100,000 | 1000 |

Figure 6:
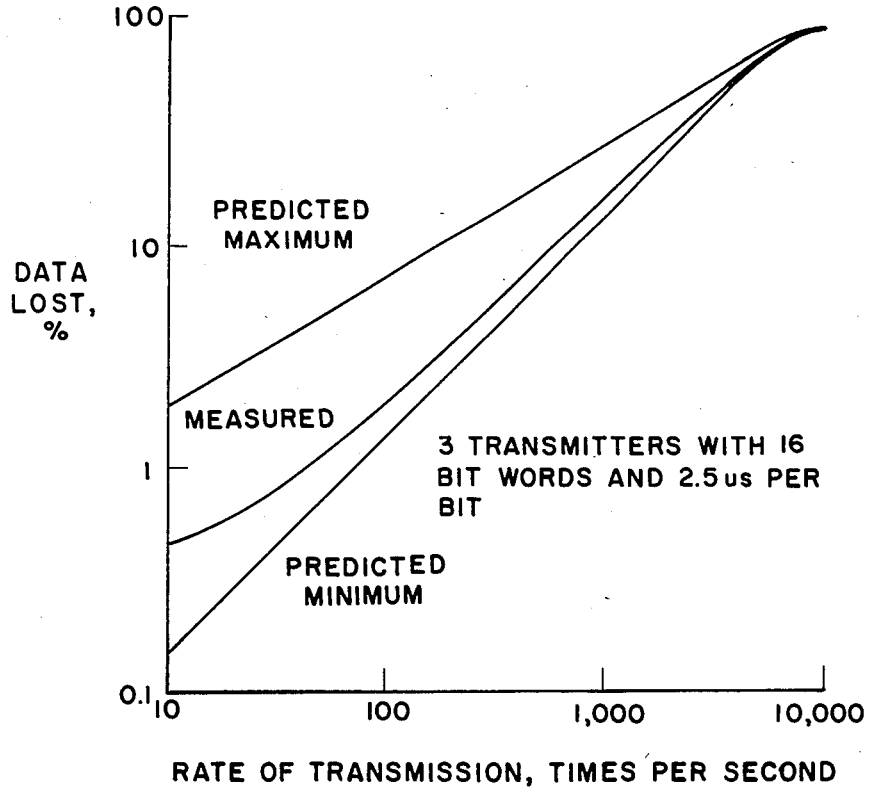
FIG. 6 is a plot of percent of overlap data versus transmission rate for a system employing three transmitters with 16 bits per word and 2.5 microseconds per bit.

Exact transmission rates are not possible with physically realizable transmitters because of component stability. This results in transmission rate drift which prevents two transmitters from having frequent, periodic overlap. Another factor to consider is the proximity of the transmission rates. Even though two transmitters can have a low average overlap occurrence over a long period they may have sequential overlaps during a short period if the tranmission rates are too close together. That condition is not desired so precautions are taken to avoid it by making the sample rate differ by at least one sample length. FIG. 6 is a plot of percent of overlap data versus transmission rate for a system employing three transmitters with 16 bits per word and 2.5 microseconds per bit. In this figure the predicted maximum and predicted minimum are the upper and lower bound of a family of curves obtained by the computer simulation. The measured curve was obtained from a validation test which was performed to compare the predicted overlap with results from an actual hardware implementation. The hardware implementation consisted of three transmitters with their respective encoding logic and decoder, data verification circuitry, and an overlap detector. The radio frequency path was simulated by circuitry, the diagnostic circuitry consisted of a set of counters interfaced to the transmitters and the decoder in the receiver.

Two types of errors may be considered which result from data loss and are defined as momentary error, which is the worst error at any time, and overall error, which is the average error. The following examples illustrate momentary error and overall error: given a transmission of 100 samples, if sample No. 2 is lost, then the momentary error is determined by a reduction of 50% in sample rate, and the overall error is determined by a 1% reduction in sample rate; if all even numbered samples are lost, then the momentary error is still determined by a 50% reduction in sample rate, whereas the overall error is now also determined by a 50% reduction in sample rate. This discussion of overlap effect is concerned only with the momentary error since it is equal or greater than the overall error.

The data loss error is produced by an increase in aliasing error due to an effective decrease in sample rate. Prior to sampling, analog waveforms are filtered by low pass filters to eliminate frequency components higher than the sampling system can follow. Because filters are not ideal (less than infinite attenuation over the rejection band) there is an aliasing error associated with sampling that depends on the filter sharpness and the ratio of the sampling rate to the filter cut-off frequency.

The relative rms errors due to aliasing is calculated by the square root of the ratio of the error power to the signal power.

$$V_e = \sqrt{V_{ae}^2/V_s^2} \tag{1}$$

where $$V_{ae}^2 = \frac{2^{2m-1}Afo}{2m-1}(f_o/f_s)^{2m-1} \tag{2}$$

$$V_s^2 = \frac{Afo}{2m}\,\text{cosecant}\left(\frac{\pi}{2m}\right) \tag{3}$$

m is the number of poles of the filter used to filter the signal, $f_o$ is the 3 db cut-off frequency of the filter, $f_s$ is the sampling frequency, and A is the mid-frequency band gain.

Figure 7:
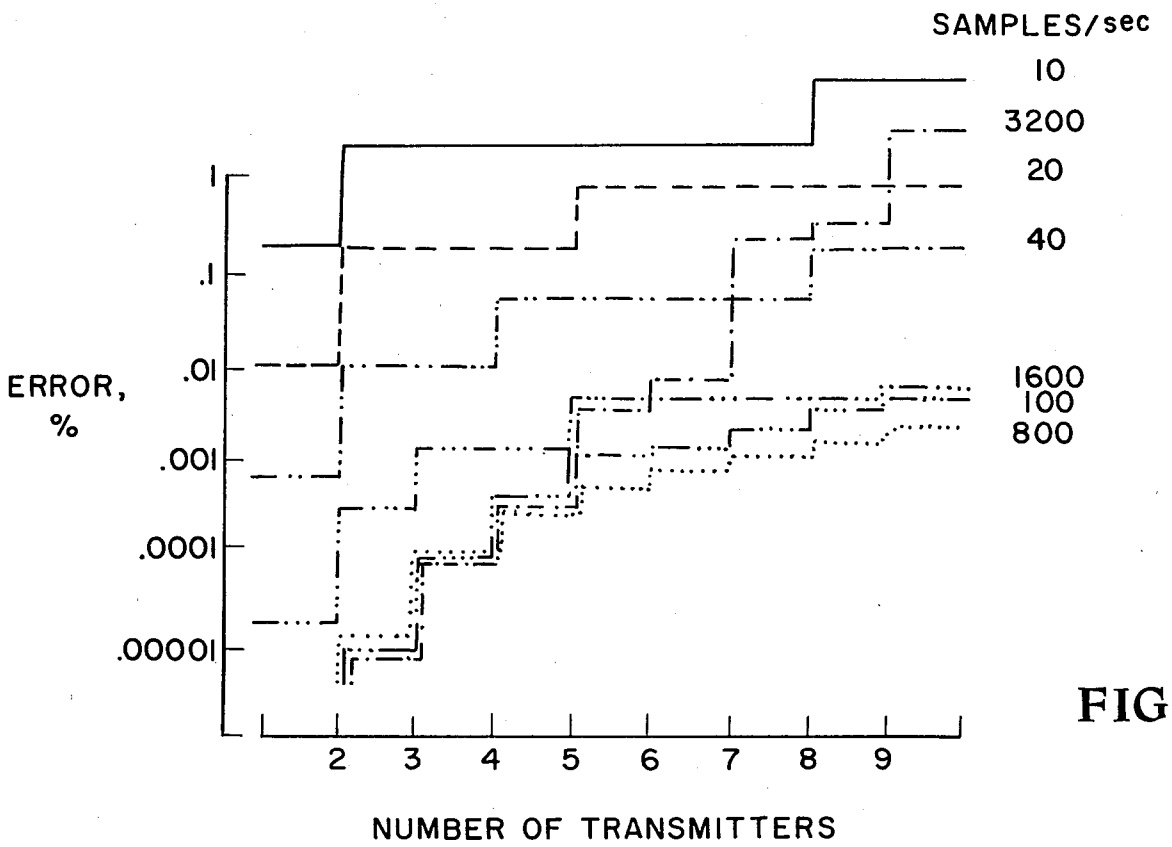
FIG. 7 is a plot of error due to data loss versus number of transmitters for different transmission rates with 40 microsecond sample length and signal bandwidth of 1 Hz.

Using a four pole filter and a normalized sampling frequency ($f_s/f_o$) of 10, the error due to aliasing will be under 0.2 percent; when a sample is discarded (equivalent to $f_s/f_o=5$) the error will be under 2% during the period of the missing sample. Although this error increase is significant, it is tolerable for this application. This analysis assumes that the high frequency components of the signal have the same power spectrum as the frequency components of interest. The error produced by missing samples is obtained by calculating the aliasing error with:

$$f_s^* = f_s/(c+1) \tag{4}$$

as below:

$$V_{ae}^2 = \frac{2^{2m-1}Afo}{2m-1} f_o/f_s^{*2m-1} \tag{5}$$

where $f_s^*$ is the effective sampling rate at the moment of the missing sample and c is the number of consecutive samples missed. FIG. 7 is a plot of error due to data loss versus number of transmitters for different transmission rates with 40 microsecond sample length and signal bandwidth of 1 Hz. This error plot was obtained by substituting (5) in (1) with:

m=4

$f_o$=1 Hz and with $f_s^*$ obtained using (4) with c determined by observing the maximum number of consecutive samples lost during a simulation run (containing 100,000 samples) for each number of transmitters. (The step changes in error occur at discrete changes in c.)

For the General Aviation Data System application (9 transmitters, 2 Hz signal bandwidth and 40 μs sample length) a minimum aliasing error of less than 0.01 percent is obtained with a sample rate of 800 samples per second. For other applications a compromise should be made between link accuracy, number of channels (transmitters), RF bandwidth (sample length) and signal bandwidth (sample rate).

The advantages of this invention is that it provides a telemetry system that uses unique multiplexing techniques that makes the system simple and inexpensive.

What is claimed is:

1. A single frequency multitransmitter telemetry system comprising:

a plurality of sensors with each sensor at a different location;

a plurality of transmitters with each transmitter connected to the output of one of said sensors for transmitting the output of the sensor;

each of said transmitters including means for modulating the output of its sensor in frequency shift keying with frequencies $f_o$ and $f_o+\Delta f$ so that all of said transmitters, when transmitting, transmit one or the other of said frequencies; and a receiver means including a single receiver input for receiving from all of said transmitters the modulated outputs from said sensors, said receiver means further comprising means for accepting data from said transmitters only one transmitter is transmitting and for discarding data from the transmitters when more than one transmitter is transmitting.

2. A telemetry system according to claim 1 including a plurality of analog-to-digital converter means with each connected to its corresponding sensor for converting the sensor analog output to a serial binary output before it is transmitted.

3. A telemetry system according to claim 2 wherein said modulating means includes means for producing the frequency $f_o$ when the said serial binary output is "1" and for producing the frequency $f_o+\Delta f$ when the said serial binary output is "0".

4. A telemetry system according to claim 3 wherein said receiver means comprises an RF detector having two outputs with the detected $f_o$ appearing on one output and with the detected $f_o+\Delta f$ appearing on the other output and means for retaining the data on said one output when there is no overlapping data on said other output and for discarding the data on said one output when there is overlapping data on said other output.

5. A telemetry system according to claim 4 wherein said means for retaining data when there is no overlapping data and for discarding data when there is overlapping data includes a shift register connected to said one output for collecting words of data transmitted by said transmitters and means connected to said one and said other outputs for gating the data in said shift register out of said receiver each time a word is transmitted, for clearing said shift register after the data has been gated out if there is no overlapping data and for clearing said shift register before the data is gated out if there is overlapping data.

6. A telemetry system according to claim 5 wherein said means for gating the data in said shift register out of said receiver includes a data buffer connected to the output of said shift register, means for enabling said data buffer at the end of each word, for clearing said shift register after said data buffer is enabled if there is no overlapping data and for clearing said shift register before said data buffer is enabled if there is overlapping data.

7. A telemetry system according to claim 6 wherein said means for enabling said data buffer at the end of each word includes logic circuit means response to binary "0"s at both outputs of said RF detector at the end of each word to produce a binary "1" for enabling said data buffer.

8. A telemetry system according to claim 7 wherein said logic circuit means includes an "or" gate having its two inputs connected to the two outputs of said RF detector, an inverter connected to the output of said "or" gate, an "and" gate connected to the output of said inverter and means for applying a binary "1" to said "and" until there is an overlap of data and thereafter applying a binary "0" to said "and" until the end of a word.

9. A telemetry system according to claim 8 including means for connecting the output of said inverter to said shift register to clear said shift register whenever a binary "1" appears at the output of said inverter.

10. A method for transmitting data from a plurality of sensors, said method comprising the steps of:

converting output data from each of the sensors into a serial binary signal;

transmitting the output data from each of said sensors at one or the other of two frequencies using a corresponding plurality of transmitters individual to each of said sensors, the binary "ones" in the serial binary signal from each sensor being transmitted at a first frequency and the binary "zeros" in the serial binary signal from each sensor being transmitted at a second frequency;

receiving the signals being transmitted from said plurality of transmitters at a single input;

frequency detecting the transmitted signal or signals received at said single input to produce output signals corresponding to the first and second frequencies at respective ones of first and second outputs;

retaining the received data when there is no overlapping of binary "ones" corresponding to said first frequency at said first and second outputs; and discarding the received data whenever there is an overlapping of binary ones corresponding to said first frequency at said first and second outputs.

* * * * *